United States Patent [19]

Gerber et al.

[11] 4,004,517

[45] Jan. 25, 1977

[54] PYROTECHNIC MUNITION AND PROCESS

[75] Inventors: Melvin N. Gerber, Randallstown; Robert T. Cannon, Churchville; Mitchell E. Penn, Randallstown, all of Md.

[73] Assignee: The United States of America as represented by the Secretary of the Army, Washington, D.C.

[22] Filed: Jan. 2, 1975

[21] Appl. No.: 538,298

[52] U.S. Cl. ..... 102/65; 425/DIG. 12

[51] Int. Cl.[2] ..... F42B 27/06

[58] Field of Search ..... 425/DIG. 12, DIG. 43; 102/65

[56] References Cited

UNITED STATES PATENTS

| | | | |
|---|---|---|---|
| 2,752,731 | 7/1956 | Altosaar | 425/DIG. 12 |
| 3,001,363 | 9/1961 | Thibodaux, Jr. et al. | 425/DIG. 12 |
| 3,193,883 | 7/1965 | Thibodaux, Jr. et al. | 425/DIG. 12 |
| 3,196,735 | 7/1965 | Baldwin | 425/DIG. 43 |
| 3,270,999 | 9/1966 | Fowler et al. | 425/DIG. 12 |
| 3,324,795 | 6/1967 | Miles et al. | 60/255 |
| 3,421,325 | 1/1969 | Thibodaux, Jr. | 425/DIG. 12 |
| 3,726,225 | 4/1973 | Gerber et al. | 102/65 |
| 3,792,661 | 2/1974 | Turetsky | 102/65 |

FOREIGN PATENTS OR APPLICATIONS

| | | | |
|---|---|---|---|
| 676,816 | 12/1963 | Canada | 425/DIG. 12 |

*Primary Examiner*—Verlin R. Pendegrass
*Attorney, Agent, or Firm*—Nathan Edelberg; Robert W. Church

[57] ABSTRACT

A new pyrotechnic munition having an expendable and disintegrable mandrel and a process of manufacture thereof.

4 Claims, No Drawings

PYROTECHNIC MUNITION AND PROCESS

The invention described herein may be manufactured and used by or for the Government for Governmental purposes without the payment of any royalties thereon or therefor.

BACKGROUND OF THE INVENTION

The present invention relates generally to the field of munitions and to the processes of manufacturing such items. Though our invention, as will be explained later, is applicable elsewhere.

Persons working in the field of munition research and development are continually engaged in the never ending effort to improve munitions both as an article of manufacture and in the manufacturing process therefor. This constant endeavor has brought to fruition the instant invention.

In the past, before the instant invention, orifices, holes and relief areas to be had in case of molded articles were generally made after the molding or casting operations. Boring, drilling, extruding, cutting, etc. were and still are conventional techniques to accomplish this end. To eliminate waste, manufacturing time, etc., alternatively, it is now conventional to cast or mold recesses, holes, cavities, etc., by the use of cores, mandrels, cope and drag arrangements, etc. So also, it is conventional to use high temperature (than the material being worked on) resistant materials as the molds and mandrels. That is, the use of steel as the mold when casting copper or molding plastic, is an example.

All of the above recited techniques of manufacturing articles involving molding and casting steps have serious drawbacks. When making recesses, holes, apertures and the like in finished molded and cast articles as aforementioned, additional manhours and process steps are always required. So also, product costs are high because machining costs such as cutting, drilling, boring, etc. are high. When the recesses, apertures, and holes, are molded or cast in place machining costs are reduced, and casting and molding material is saved because less is utilized. However, mandrels, cores and pins for making same must still be removed. Hence, costs of production, etc. still plagues the casting, molding and pressing article making arts. In each of the above, a finished article made by a molding or casting operation has variations in size and shape due to machine tool wear and variance and due to the many variable associated with molding and casting with mandrels, cores, etc. which must be removed. Heretofore, the sizes and shapes of certain articles have, until the present invention, been dictated by molding techniques and requisites. That is, in order to remove certain of the molding and casting components, such as mandrels, cores, pins, etc. it has been necessary to create tapers and drafts.

Our invention was conceived and reduced to practice to solve the above described problems and to satisfy the long-felt need of producing uniform cast, molded and pressed articles of manufacture at the most economical rate.

Briefly, our invention is a new apertured munition which has either been cast, molded or pressed with a combustible or disposable core or mandrel therein. And a new and unobvious process of molding, casting and pressing during manufacturing of our munition whereby core and mandrel cleaning and removal is eliminated. Hence, our invention is to mold, cast or press an article (having one or more mandrels) to shape and to leave it or them in place until use thereof so that the mandrels can be used to protect it in the storage and shipment of the article. And then in use, the mandrel or mandrels can be removed either during use or preparatory thereto.

A principal object of our invention is to provide an apertured article of manufacture with the apertures either fully or partially closed by molding, casting and pressing mandrels.

Another object of our invention is to provide an apertured, article of manufacture with apertures formed and kept closed at least partially by molding, casting or pressing mandrels until the article is used.

A further object of our invention is to provide an apertured article with mandrel reinforcement kept within the apertures for storage and handling purposes until use.

A still further object of our invention is to provide apertured articles of manufactures with molding, casting or pressing mandrels closing at least partially said apertures for handling until use and said mandrels are removed by environmental factors when the article is placed in use.

Other objects will become more apparent after considering the following description of the invention in conjunction with the accompanying drawings.

DESCRIPTION OF OUR INVENTION

Figure 1:
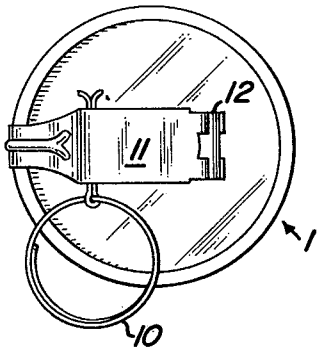
FIG. 1 shows the top view of our invention munition.
Figure 2:
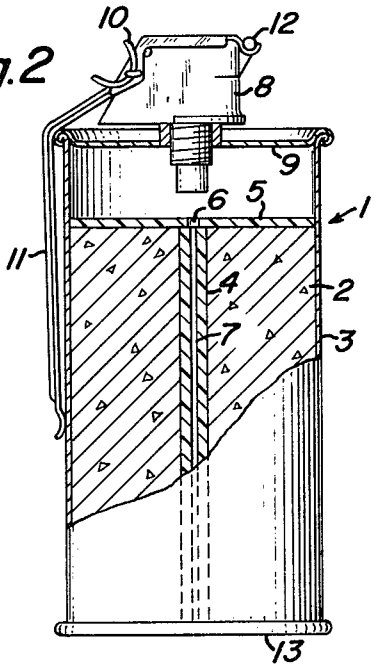
FIG. 2 shows a side or plan view of our invention munition.

Referring to FIGS. 1 and 2, numeral 1 represents our invention munition. It is comprised of canister or container 3 filled with payload smoke mix 2. Overlaying the mix 2 can be disposed a first fire material 5. Element 4 is one of the many possible examples of our new and unobvious expendable and disintegrable molding, pressing and casting mandrel. Closing off the upper end of container or canister 3 is end cap or cover 9 to which is affixed dispensing head 8, to be described in more detail later.

Though numerous payloads are useable with our invention mandrel, one which has been used with success in the field of occular impedimentation or as a smoke control agent is set out below. It has been developed for this purpose and is deemed new and unobvious in its own right.

Smoke mix 2 comprises 37 wt% granulated dye, 23 wt% potassium chlorate; 2 wt% ethylene bis (isothisosemicarbazide); 16 wt% Versamid 140 resin by General Mills Corp.; 11.4 wt% plasticiser santisizer "141" by Monsanto Chemical Corp. and 10.6 wt% XFS-4013L thioepoxy resin by Dow Chemical Co. It is extrudable. Though it is understood that other castable, moldable and pressible materials will work as well.

Each component listed in the above example is placed in a conventional mixing apparatus and mixed until a homogenous mass is obtained. In the above example, Sodium bicarbonate can be utilized to reduce the amount of flame generated on ignition of the smoke mix 2 and to control the smoke mix 2 burning rate. This will necessitate reducing the dye and Chlorate portions proportionally. After achieving a homogenous mass, it is cast or extruded in container or canister 3. Element 4 is our disposable molding, casting or pressing mandrel which is of a combustible composition here. In the smoke mix munition 1 we have made mandrel 4 of polyurethane foam material consisting of approximately 50 wt% potassium chlorate, 30 wt% Isofoam PE4A[1] and 20 wt% Isofoam PE4W[1]. The "Isofoam" materials and designations are from the Witco Chemical Company of New Castle, Delaware. Overlaying the smoke mix 2 is first fire material 5 disclosed and made in the fashion described in U.S. Pat. No. 3,726,225. Though other first fire materials could be used as well. Note, it has orifice 6 which enables combustion to take place on mandrel 4 and then create the aperture occupied by mandrel 7 to cause the mix 2 to be burned. Dispensing head 8 of a conventional type more elaborately described in U.S. Pat. No. 3,434,421, and affixed to cover 9, actuates the first fire means 5 which in turn actuates the payload 2. Briefly, after pulling pin 10 spring loaded handle 11 is releasable. Then, dispersing and actuator fuse head 8 is ready for use. Once handle 11 is released, as by throwing in a conventional manner, the spring force on handle 11 forces same to pivot on pin 12 and fall off thereby actuating fuse means in head 8. Since handle 11 falls off, canister 3 cannot be shut off once put in use. Thus, pyrotechnic erosion of smoke mix material 2 continues until the canister 3 has been emptied. For a more detailed description of the various usable dispensing and actuator heads, reference is made to U.S. Pat. No. 3,434,421, U.S. Pat. No. 1,894,203, or to U.S. Pat. No. 3,792,661, hereby incorporated by reference.

The invention of FIGS. 1 and 2 relates to munition devices of the type generally referred to as "gas generators", "gas grenades", and similar devices for disseminating disabling and incapacitating gas, such as tear gas, CS gas, etc. It is for the suppression of mobs, riots, warfare, etc. In operation, pulling pin 10 and releasing handle 11 causes actuator dispenser means 8 to ignite first fire material 5. It then ignites mandrel 4 which becomes ignited along its entire length of aperture 7. Once mandrel 4 commences burning, the heat and pressure cause erosion of mix 2. Then further burning causes more heat-pressure to develop to either blow open sealed exhaust ports (not shown) of container or canister 3 or to exhaust through head 8.

Figure 3:
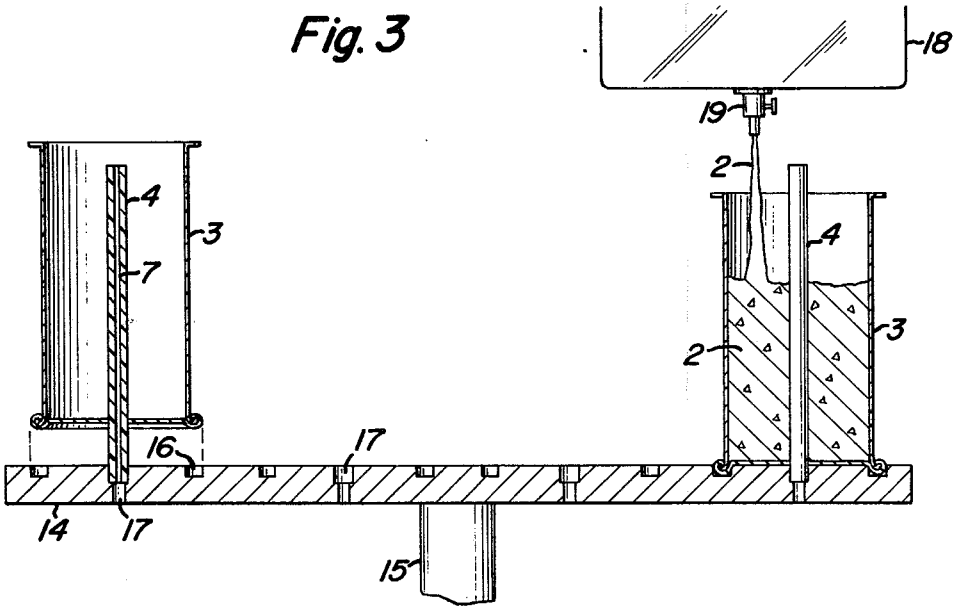
FIG. 3 shows our invention manufacturing process.

In the manufacture of our munition invention of FIGS. 1 and 2 the following described apparatus is preferred. Referring to FIG. 3 of the drawings we have provided a mass production arrangement by the use of a rotatable casting, molding, or pressing table 14 driven as for example by motor means, not shown. The motor means can provide either continuous or timed step-by-step cyclic movement to table 14. Any conventional motor or power means will suffice to rotate shaft 15. Table 14, though it could be of most any shape, is circular and has provided therein recesses 16 which receive the flanges of container or canister 3. So also, through-holes 17 of double diameter are provided to temporarily hold mandrel 4 in an upright position. Container or canisters 3 and mandrels 4 of precut lengths are successively assembled to rotating table 14 either together or singly by assembling apparatus having chutes and finger means (not shown), for example. Typical can dispensing equipment works well. Right most, in FIG. 3, is element 18 which represents smoke mix 2 dispensing head. Dispensing head 18 has adjustable valve 10 for controlling mix 2 fill speed.

Figure 4:
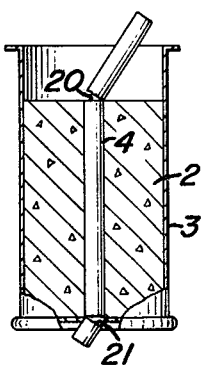
FIG. 4 depicts a disposable mandrel of our invention being sized.

For the purposes of illustration, at least six stations are used in our automated process. A container or canister assembly station, not shown, which assures that container or canister 3 is properly supplied and that it is oriented in one recess 16 is first provided. Second, a mandrel 4 assembly station (not shown) successively locates mandrels 4 in holes 17 after table 14 is rotated from the container station and positioned thereat. Spacially removed from the above-mentioned canister and mandrel assembly stations is the filling station. Its function is to dispense mix 2 into container or canister 3 in controlled amounts as shown in FIG. 3 whereat mix 2 is being dispensed into container or canister 3. A castable fluid material must harden before the mandrel sizing operation can be performed. For sizing the mandrel 4 and cutting same at 20 and 21 of FIG. 4 another station with rotatable cutting means (not shown) is provided. This cutting operation is depicted in FIG. 4. For completing the assembly of the munition depicted in FIG. 2, one or more stations are provided for disposing and for assembling first fire material 5 over mandrel 4 and mix 2 and canister 3 readied to receive cover 9.

Figure 5:
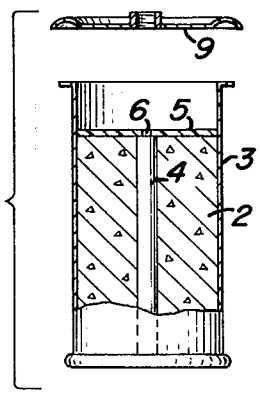
FIG. 5 depicts a partially completed munition component of our invention of FIG. 2.

The process of manufacture using the apparatus of FIG. 3 is as follows. Table 14 is rotated from station to station. In operation, table 14 rotates to canister 3 loading station whereat same is assembled in recess 16. Then mandrel 4 is assembled thereto. Though it is understood that mandrel 4 could be first assembled to table 14 and/or assembled into canister 3 and then the combination could be assembled to table 14. Assembled container or canister 3 and mandrel 4 are then rotated to the fill station, whereat the mix 2 is controllably disposited by way of filler 18 therein and thereabout. Castable or fluid material 2 must harden before going to the cutting station. Then the table is rotated to the cutting station, where the result shown in FIG. 4 is had. That is, either the upper portion 20 is cut off or the now poured or filled canister assembly 3 is raised from table 14 to enable portion 21 to be also cut from mandrel 4. This can be done by a finger assembly grasping the canister 3, for example. Next the sized munition component of FIG. 4 is rotated to first fire 5 assembly station. Here, elements 5 are inserted into the munition so as to overlay the mix 2 and mandrel 4, as shown in FIG. 5. This is done by wafer assembly apparatus, not shown. Such apparatus takes the form of a filler tube from which one wafer at a time is dispensed into each successively positioned munition component as by piston means. This is done by the munition being positioned underneath and in co-axial alignment with the tube. Then the piston is timingly actuated to force the wafer or first fire means 5 into the munition component canister 3 from the tube. Next, the table is rotated to cover 9 assembly station whereat cover 9 is secured to canister 3 as by crimping. It is understood, of course, that at this station cover 9 could also be secured as by the use of adhesives and/or solders if controlled local heating were had, for example. Finally, the component munition, now comprising canister 3, the mix 2, the sized mandrel 4, the first fire wafer 5, and cover 9 is rotated to a dispensing station (not shown). Here the munition component is picked from table 14 and inserted into carrier means for transportation to other assembly apparatus for assembling element 8 to the cover, etc.

Alternatively, fuse head 8 assembly could be assembled as a part of the instant assembly station by the addition of another station which would include, at least, head alignment and feed means, and so also canister 3 and head assembly means which would relatively rotate same together to provide the assembly of FIGS. 1 and 2.

In the above described exemplary process the fill station could be modified so that the fill material could be compactable powders or viscous fluids. Thus, fill head 18 would comprise feed means and pressure piston means which compact the material 2. The piston then would have aperture means to be slidable and complementarily receive mandrel 4, for example. In this instance, mandrel 4 would comprise suitable material (woods, plastics, etc.) which would take compressive forces.

Aside from the above-mentioned, unobvious benefits had from our novel unobvious invention, other uses and adaptions of our invention are ten-fold. For example, mandrels and cores could also be dissolvable in anything from water to hydro-sulfuric acid and not depart from our invention. Moreover, the molding; casting or pressible material could be anything from concrete to woods metal without departing from our invention. So also, the mold need not be a part of the finished product as is the case with canister 3 in our example above but may be removable after the material 2 hardens.

One salient advantage of our invention, whether it be in the munition field or not, is that the mandrel acts to protect the article until use. That is, it acts as a reinforcement during shipment, storage, handling, etc. wherein shipping, breaking or granulating of the cast, molded or pressed material could take place. Also the mandrel, as aforementioned, is dissipatable during use. This is beneficial because it can aid in the use of the article; i.e., act as a promoter, primer, etc. if it be combustible, for example. So also, it could act in some instances, if it be consumable, as a retardant for example.

Referring to FIG. 3, table 14 is of steel but could be of other materials that could sustain the structural stresses and strains involved with a manufacturing process. Apertures 17 of two diameters could each be closed at the bottom end, however, then assembly and disassembly of mandrels 4 could be impeded by possible partial vacuums developing at the mandrel table interface. This is avoided by the inclusion of the bottom through-holes. So also, the bottom through-holes could be used to apply a vacuum to the mandrels if they were non-pervious or made so for hold down purposes. Also, these holes could be used as pressure ejection means whereby fluid pressure could be applied to eject the cast, molded or pressed munition component, as for example at ejection station 6.

In summary, our invention mandrel concept can be used to make any article of utility without departing from the gist of the invention. So also, the mandrel can be of metal, wood or plastic and can be either solid or hollow. Also, the mandrel can be shape disintegrable, by fracture, by dissolution, or by heat as by melting, and by vaporization without departing from our invention.

It is obvious that other modifications can be made of our invention, and we desire to be limited only by the scope of the appended claims.

We claim:

1. A munition of the pyrotechnic type comprising: a canister for containing a smoke payload; a formed smoke payload therein comprising 37 wt per cent granulated dye, 23 wt per cent potassiumchlorate, 2 wt per cent ethylene bis (isothisosemicarbazide), 16 wt per cent polyamide resin; 11.4 wt per cent plasticizer sanitisizer and 10.6 wt per cent thioexpoxy resin, a disposable payload forming mandrel; and a dispensing head.

2. The munition of claim 1 wherein said mandrel is hollow.

3. The munition of claim 1 wherein said forming mandrel is for payload forming by molding.

4. The munition of claim 1 wherein the forming mandrel is for payload forming by pressing.

* * * * *